US006529229B2

(12) United States Patent
Nagumo

(10) Patent No.: US 6,529,229 B2
(45) Date of Patent: Mar. 4, 2003

(54) DRIVING CIRCUIT, PRINTED WIRING BOARD, AND PRINT HEAD WITH CLOCK INVERTING CIRCUITS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 39 days.

(21) Appl. No.: 09/764,084

(22) Filed: Jan. 19, 2001

(65) Prior Publication Data

US 2001/0009435 A1 Jul. 26, 2001

(30) Foreign Application Priority Data

Jan. 24, 2000 (JP) ..... 2000-014443

(51) Int. Cl.[7] ..... B41J 2/435
(52) U.S. Cl. ..... 347/237; 347/248
(58) Field of Search ..... 347/237, 247, 347/234, 248; 327/297; 326/93, 96

(56) References Cited

U.S. PATENT DOCUMENTS 5,864,253 A 1/1999 Katakura et al. ..... 327/297
6,229,341 B1 * 5/2002 Yamauchi ..... 326/96

* cited by examiner

*Primary Examiner*—Hai Pham
(74) *Attorney, Agent, or Firm*—Rabin & Berdo, P.C.

(57) ABSTRACT

A print head includes a driving circuit having a cascaded series of driver integrated circuits mounted on a printed wiring board. Differential clock signals are supplied to the driver integrated circuits to synchronize the transfer of print data through the cascaded series. Even-numbered driver integrated circuits and odd-numbered driver integrated circuits are connected differently to the clock signal lines, but the even-numbered (or odd-numbered) driver integrated circuits generate an inverted internal clock signal, thereby compensating for the difference. This enables the clock signal lines to be mutually adjacent and to have a weaving layout that yields improved noise immunity.

19 Claims, 15 Drawing Sheets

DRIVING CIRCUIT, PRINTED WIRING BOARD, AND PRINT HEAD WITH CLOCK INVERTING CIRCUITS

BACKGROUND OF THE INVENTION

The present invention relates to a driving circuit that drives an array of recording elements, such as light-emitting diodes in an electrophotographic printer or heating elements in a thermal printer.

The light-emitting diodes (hereinafter, LEDs) in an electrophotographic printer illuminate a charged photosensitive drum, responsive to print data, thereby creating an electrostatic latent image. The latent image is developed with toner, transferred to paper, and fused onto the paper. The driving circuit in this case typically includes about twenty-six driver integrated circuits (ICs) that drive respective LED array chips. The print data are transferred from one driver IC to the next in synchronization with a clock signal.

U.S. Pat. No. 5,864,253 discloses a print head that employs a differential pair of clock signals, which are supplied in parallel to the driver ICs. One purpose of this arrangement is to avoid having the clock signals generate electromagnetic interference. Since the two clock signals are complementary, electromagnetic radiation from one clock signal line is canceled out by electromagnetic radiation from the other clock signal line.

When the clock signal lines are widely separated, however, as shown in the above patent, they are themselves susceptible to external electromagnetic interference, referred to below as noise. Another problem is that if the widely separated clock signal lines have stubs for delivery of the clock signals to the driver ICs, the clock signals may be partly reflected at the stubs. Both noise and reflections distort the waveforms of the clock signals, sometimes making it difficult for the driver ICs to detect the relative levels of the clock signals correctly. A particular problem is distortion of the transitions of the clock signal waveforms by multiple reflections. In the worst case, such distortions can cause data transfer errors, leading to incorrect printing.

Further information about these problems will be given in the detailed description of the invention.

SUMMARY OF THE INVENTION

An object of the present invention is to increase the noise immunity of a driving circuit that transfers print data in synchronization with a pair of differential clock signals.

Another object of the invention is to reduce reflection of the differential clock signals.

Still another object is to increase the clock frequency at which the driving circuit can operate.

The invented driving circuit supplies driving current to an array of recording elements, responsive to the print data. In addition to having first and second clock signal lines carrying differential clock signals, the driving circuit has a cascaded series of driver ICs with respective first clock input terminals and second clock input terminals. The clock signal supplied to the first clock input terminal of the first driver IC is supplied to the second clock input terminal of the next driver IC in the cascaded series. Conversely, the clock signal supplied to the second clock input terminal of the first driver IC is supplied to the first clock input terminal of the next driver IC.

The driver ICs also have respective data input terminals and data output terminals, which are interconnected for transfer of the print data from one driver IC to the next in synchronization with the differential clock signals. Each driver IC may generate an internal clock signal from the differential clock signals received at its clock input terminals, and use the internal clock signal to synchronize the transfer of the print data.

Preferably, the first clock signal line is coupled to the first clock input terminals of odd-numbered driver ICs and the second clock input terminals of even-numbered driver ICs in the cascaded series, the second clock signal line is coupled to the second clock input terminals of the odd-numbered driver ICs and the first clock input terminals of the even-numbered driver ICs, and at least the even-numbered driver ICs have a clock inverting circuit for inverting the internal clock signal.

The invention also provides a printed wiring board including the invented driving circuit. On this printed wiring board, the first and second clock signal lines are preferably mutually adjacent, and preferably weave around electrode pads and/or wiring patterns used to interconnect the driver ICs. The preferred even-odd variation of the interconnections between the driver ICs and the clock signal lines facilitates the mutually adjacent weaving layout of the clock signal lines, which improves their noise immunity.

The clock signal lines preferably include in-line electrode pads to which the clock input terminals of the driver ICs are coupled. The in-line electrode pads reduce reflection of the clock signals because they avoid characteristic-impedance discontinuities.

The clock inverting circuit may be a switching circuit, present in all of the driver ICs, that selectively interchanges the inputs to a differential amplifier. The inputs are interchanged in even-numbered driver ICs but not in odd-numbered driver ICs. The differential amplifier generates the internal clock signal. This arrangement avoids timing differences between even-numbered and odd-numbered driver ICs, enabling the clock frequency to be increased.

DETAILED DESCRIPTION OF THE INVENTION

Figure 1:
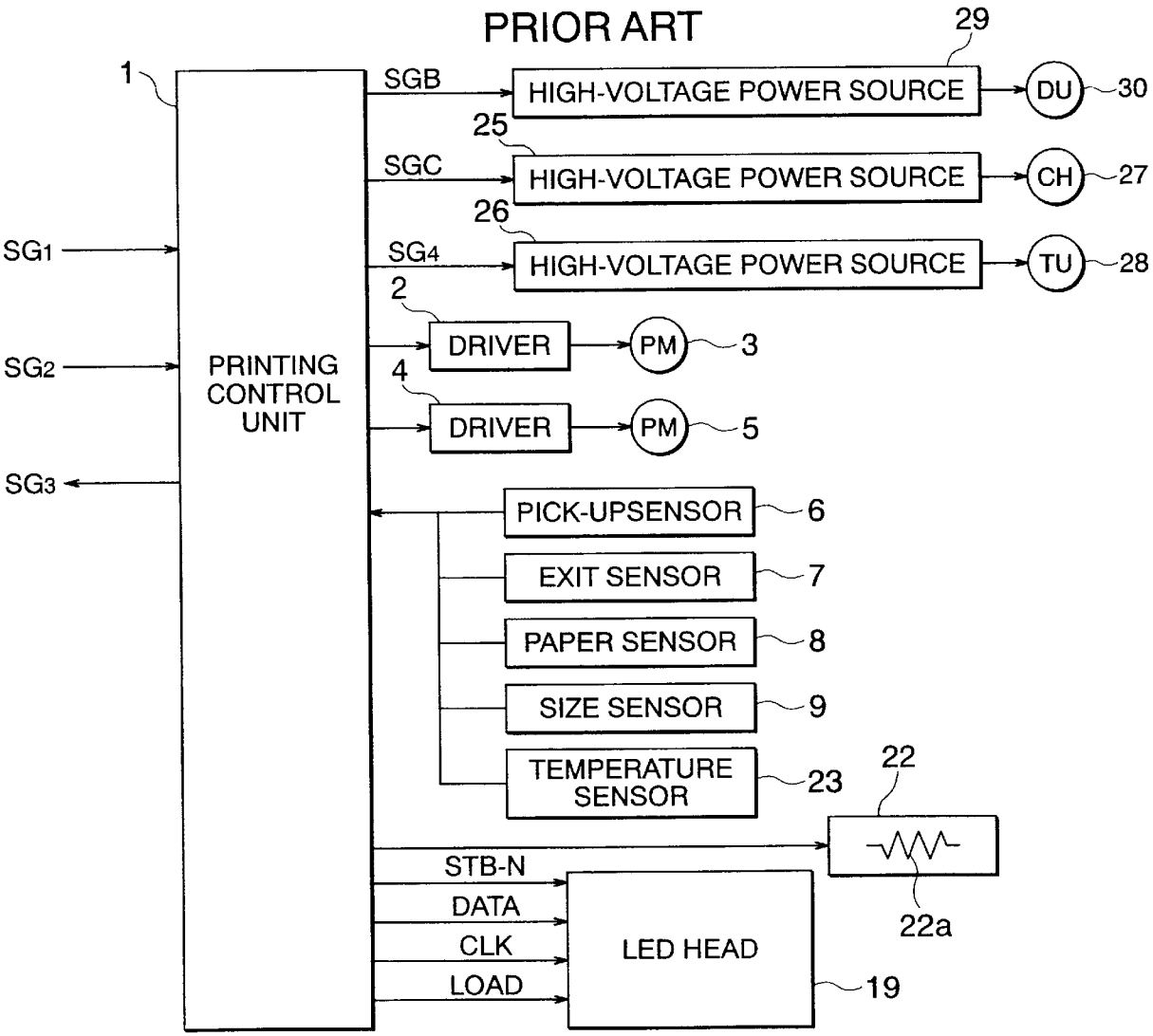
FIG. 1 PRIOR ART
FIG. 1 is a block diagram of the control system of an electrophotographic printer having an LED print head.

Embodiments of the invention will be described with reference to the attached drawings, in which like parts are indicated by like reference characters. The suffixes P and N will be attached to certain signal names, P denoting positive logic (active high), N denoting negative logic (active low).

As an example of an apparatus in which the invention can be usefully employed, FIG. 1 illustrates the control system of an electrophotographic printer with an LED printing head. The printer comprises a printing control unit 1, a first motor driver 2 and stepping motor (PM) 3, a second motor driver 4 and stepping motor 5, a pick-up sensor 6, an exit sensor 7, a paper sensor 8, a size sensor 9, the LED head 19, a fuser 22 with a heater 22*a,* a temperature sensor 23, a pair of high-voltage power sources 25, 26, a charge unit 27, a transfer unit 28, another high-voltage power source 29, and a developer unit 30.

The printing control unit 1 is a computing device comprising a microprocessor, read-only memory (ROM), random-access memory (RAM), input-output ports, timers, and other facilities. Receiving commands and data from a higher-order controller, the printing control unit 1 provides print data to the LED head 19, and generates signals that control the printing sequence. Specifically, the printing control unit 1 controls the power sources 25, 26, 29, motor drivers 2, 4, LED head 19, and fuser 22.

The printing sequence starts when the printing control unit 1 receives a printing commad $SG_1$ from the higher-order controller. First, the temperature sensor 23 is checked to determine whether the fuser 22 is at the necessary temperature for printing. If it is not, current is fed to the heater 22*a* to raise the temperature of the fuser 22.

When the fuser 22 is ready, the printing control unit 1 commands motor driver 2 to drive stepping motor 3, which turns a photosensitive drum and associated rollers (not visible). The printing control unit 1 also activates a charge signal SGC to turn on high-voltage power source 25, charging the charge unit 27 to a negative potential. The paper sensor 8 is checked to confirm that paper (not visible) is present, and the size sensor 9 is checked to determine the size of the paper. If paper is present, stepping motor 5 is driven according to the size of the paper, first in one direction to transport the paper to a starting position sensed by the pick-up sensor 6, then in the opposite direction to transport the paper into the printing mechanism.

When the paper is in position for printing, the printing control unit 1 begins receiving print data $SG_2$ from the higher-order controller, in synchronization with a timing signal $SG_3$. The printing control unit 1 sends print data (denoted DATA in the drawings) to the LED head 19 in synchronization with a clock signal (CLK). After sending each line of data, the printing control unit 1 activates a load timing signal (LOAD), causing the LED head 19 to latch the data, then activates a strobe timing signal (STB-N). The load and strobe timing signals will be referred to below simply as the load signal and strobe signal.

The LED head 19 comprises a linear array of LEDs. While the strobe signal is active, the LEDs corresponding to 1's in the print data turn on, illuminating respective dots on the photosensitive drum. The photosensitive drum is negatively charged, but the charge escapes from the illuminated dots, forming a latent electrostatic image. High-voltage power source 29 is now also activated by a control signal SGB, and toner particles, supplied by the negatively charged developer unit 30, adhere to the illuminated dots, developing the image. Next, the printing control unit 1 activates a transfer signal $SG_4$, turning on high-voltage power source 26, which supplies a positive voltage to the transfer unit 28. As the paper passes between the photosensitive drum and transfer unit 28, the toner particles are transferred from the drum to the paper. The printing control unit 1 controls high-voltage power source 26 according to the information provided by the pick-up sensor 6 and size sensor 9, so that high-voltage power source 26 is switched on only during the transfer process.

Next, the paper is transported to the fuser 22, and the toner image is fused onto the paper by heat and pressure. Finally, the printed sheet of paper passes the exit sensor 7 and is ejected from the printer, at which point the printing control unit 1 turns off high-voltage power source 25 and halts stepping motor 3.

Figure 2:
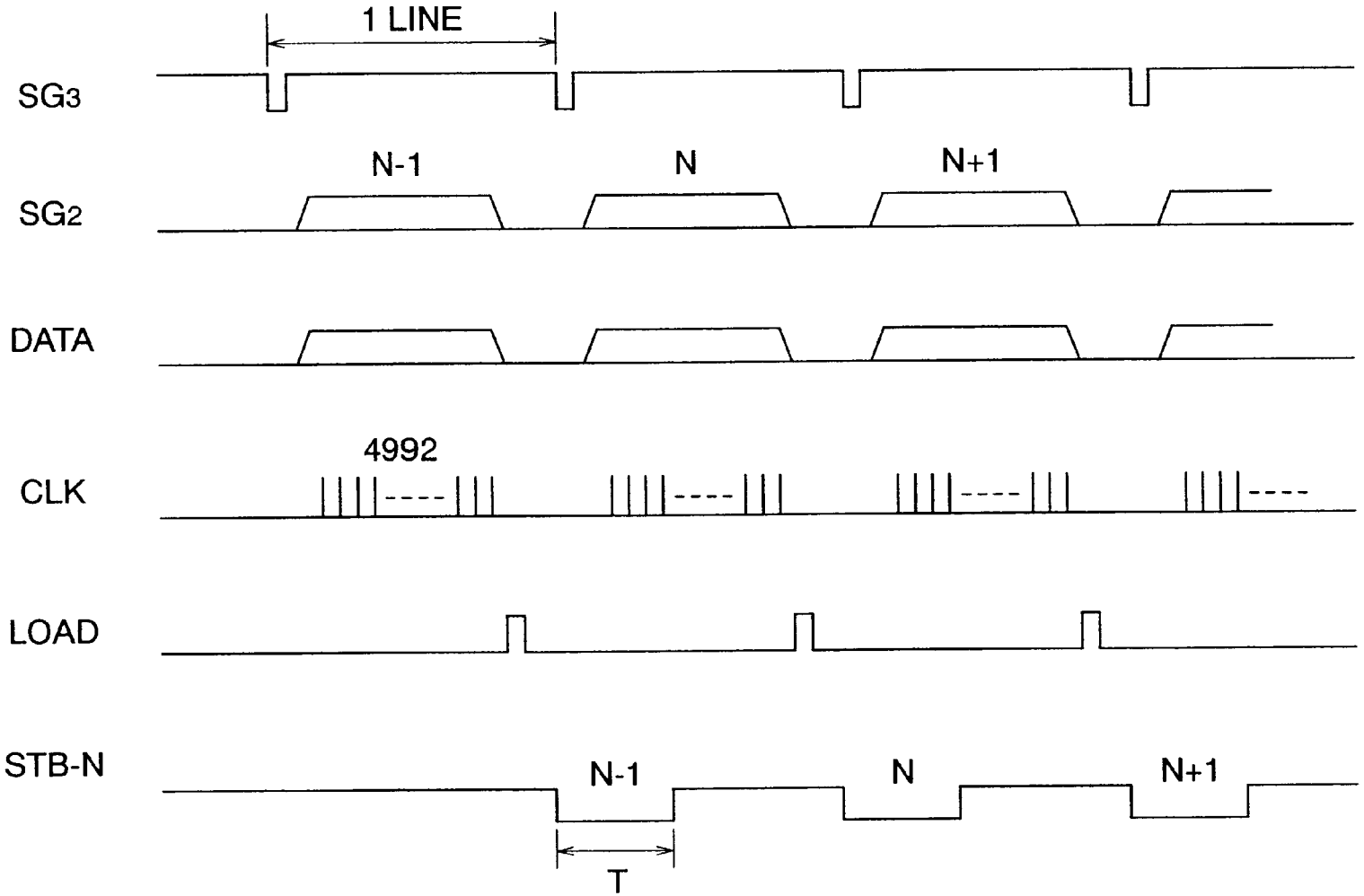
FIG. 2 is a timing diagram illustrating the transfer of and printing of print data in the LED print head.

FIG. 2 illustrates the part of the printing sequence concerned with the illumination of three dot lines (lines N−1, N, and N+1, where N is an arbitrary integer). The timing signal $SG_3$ goes low to indicate the beginning of each line. The print data $SG_2$ received by the printing control unit 1 become the print data supplied to the LED head 19 in synchronization with the clock signal (CLK). The number of dots per line is, for example, four thousand nine hundred ninety-two (4992, a number suitable for printing six hundred dots per inch on A4-size paper). The load signal is activated at the end of each line. The strobe signal (STB-N) is then activated for a time T that produces the necessary amount of illumination. As shown, this time T may overlap the time during which print data are being transferred for the next line.

Figure 3:
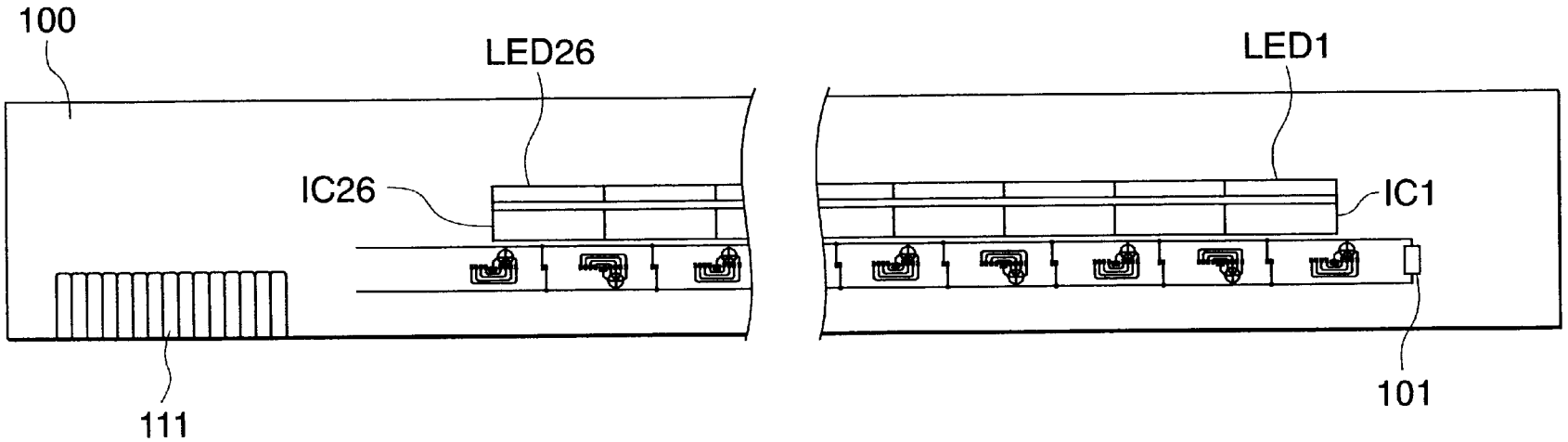
FIG. 3 PRIOR ART
FIG. 3 is a plan view of a printed wiring board conventionally used in the LED print head.

The LED head 19 in FIG. 1 includes a plurality of LED array chips and a plurality of driver ICs. In a conventional LED head employing differential clock signals, these elements are disposed on a printed wiring board 100 as shown in FIG. 3. Twenty-six LED array chips (LED1 to LED26) are disposed end to end, forming an equally spaced array of LEDs (the individual LEDs are not visible). Twenty-six driver ICs (IC1 to IC26) are disposed adjacent the corresponding LED array chips. The driver ICs are electrically coupled to the LED array chips by wire bonding, using one gold bonding wire (not visible) per LED.

The driver ICs are also coupled by wire bonding to wiring patterns formed on the printed wiring board 100. These wiring patterns conventionally include two parallel clock signal lines, which are terminated by a resistor 101, and other wiring patterns, disposed between the two clock signal lines, that interconnect the driver ICs in a cascaded series. The termination resistor 101 is matched to the characteristic impedance of the clock signal lines, to prevent unwanted reflections at the end of the clock signal lines. The wiring patterns disposed between the two clock signal lines transfer the data and load signals from one driver IC to the next. The printed wiring board 100 also has a card-edge connector 111, formed by exposed wiring patterns, by which the clock signal lines and other signal lines are interconnected to the printing control unit 1.

Figure 4:
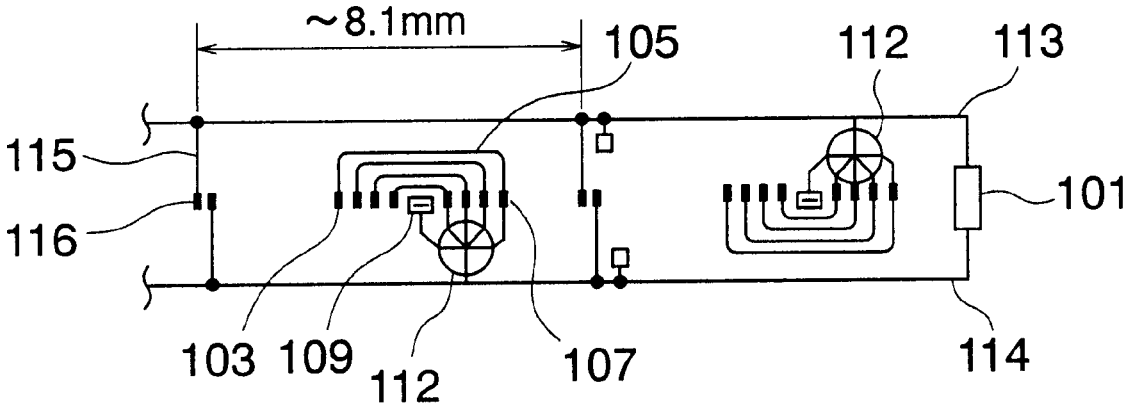
FIG. 4 PRIOR ART
FIG. 4 is an enlarged plan view of some of the signal lines and electrode pads on the conventional printed wiring board in FIG. 3.

FIG. 4 shows the conventional clock signal lines and the wiring patterns disposed between them in more detail. The four data output terminals of a driver IC are coupled by bonding wires to four electrode pads 103. These electrode pads 103 are coupled by wiring patterns 105 to four more electrode pads 107, which are coupled by bonding wires to the data input terminals of the next driver IC (the driver ICs and bonding wires are not visible). These electrode pads 103, 107 and wiring patterns 105 transfer print data signals from one driver IC to the next in the cascaded series. The load signals are similarly transferred, using electrode pads 109 disposed between the data-signal electrode pads 103, 107.

The electrode pads 103, 107, 109 are electroplated with gold during the fabrication of the printed wiring board 100. To facilitate the electroplating, the electrode pads are coupled by further wiring patterns to the clock signal lines 113, 114, which are coupled to the card-edge connector 111. After the electroplating process, these further wiring patterns are no longer needed, so they are opened by drilling holes 112 at the indicated locations. The drill holes 112 are centered at points from which traces radiate outward in groups of six to the electrode pads and clock signal lines. To accommodate the wiring patterns 105 and drill holes 112, the two clock signal lines 113, 114 must be fairly widely separated.

The clock signal lines 113, 114 also have stubs 115 leading to electrode pads 116 that are coupled by bonding wires (not visible) to the driver ICs. Thus the clock signals are supplied in parallel to the driver ICs.

Figure 5:
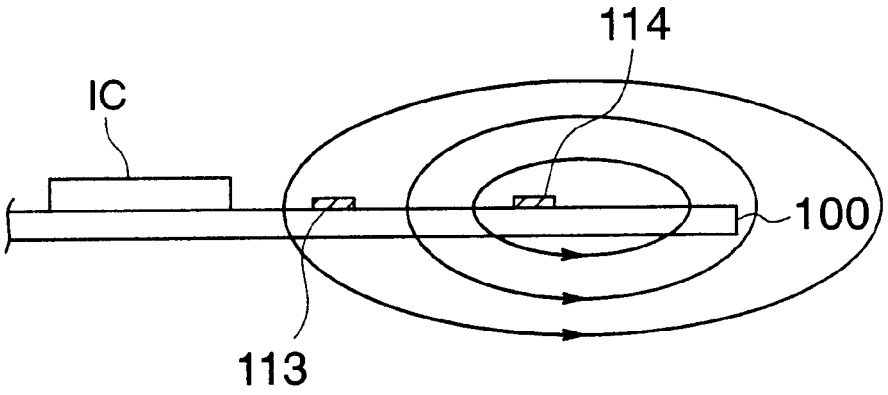
FIG. 5 PRIOR ART
FIG. 5 is a partial sectional view of the conventional printed wiring board, illustrating its susceptibility to electromagnetic interference.

FIG. 5 shows a sectional view of the conventional printed wiring board 100 in the presence of electromagnetic noise. The arrows indicate a magnetic flux generated by an external noise source (not visible). Due to the spatial separation between the two clock signal lines 113, 114, which is comparable to the width of a driver IC, the clock signal lines encounter different magnetic flux strengths (different numbers of lines of magnetic force). Different noise voltages are therefore induced in the two clock signal lines 113, 114, so that the voltage differential between the two clock signal lines does not have the desired value.

There are many possible sources of electromagnetic interference. One source is electrostatic discharge from conductive objects, such as human bodies, to the housing of the printer. This type of discharge is a common problem, especially in the winter, when dry climatic conditions promote the accumulation of static charges generated by friction.

Figure 6:
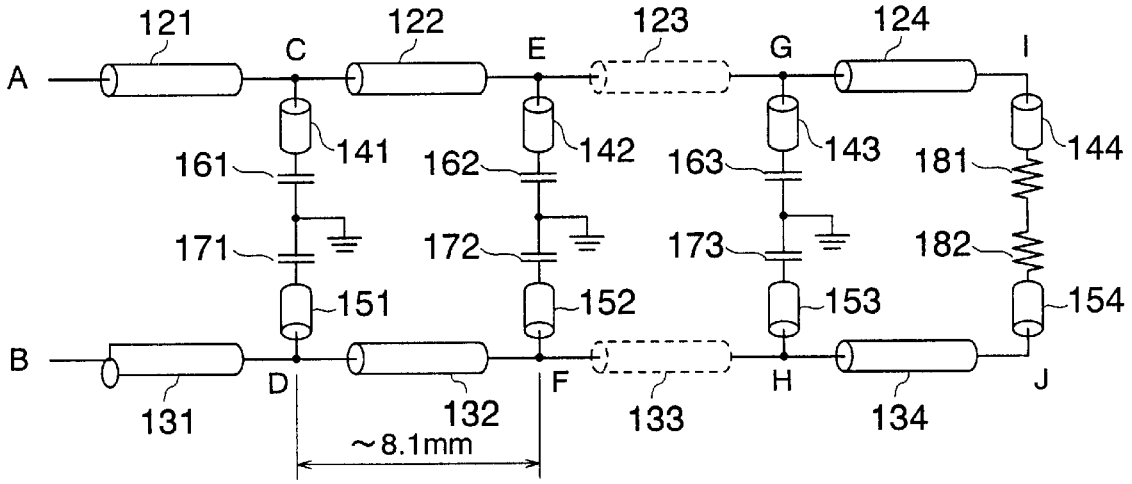
FIG. 6 PRIOR ART
FIG. 6 is a schematic diagram illustrating a circuit equivalent to the clock signal transmission lines on the conventional printed wiring board.

FIG. 6 shows an equivalent circuit diagram of the conventional clock signal lines and their stubs. The clock signal lines can be treated as transmission lines comprising line segments 121, 122, 123, 124, 131, 132, 133, 134 and stub segments 141, 142, 143, 144, 151, 152, 153, 154. The stub segments are capacitively coupled to ground through load capacitances 161, 162, 163, 171, 172, 173, which are the input capacitances of the clock input terminals of the driver ICs. The termination resistor is represented by two resistances 181, 182 mutually interconnected at a node that is coupled to ground.

Clock pulses incident at nodes A and B propagate on line segments 121, 131 to nodes C, D, from which they branch in two directions, one leading through line segments 122, 132, the other leading through stub segments 141, 151. The pulse signals propagating on the stub segments 141, 151 are reflected at load capacitances 161, 171, and return to nodes C, D.

The stub segments 141, 151 have lengths of a few millimeters, so the round-trip propagation times on the stubs is not so short, compared with the rise and fall times of the clock pulse waveform, that it can be ignored. This is especially true when high-frequency clock signals are used to achieve faster printing, forcing a reduction of the rise and fall times.

Similar reflection occurs at the other nodes E, F, G, H, and the reflected pulse signals generated at one pair of stubs enter other stubs and are reflected again. As the clock signals propagate along the transmission lines, their waveforms therefore become increasingly distorted by reflections and complex in shape. As noted earlier, these degraded clock waveforms can lead to data transfer errors in conventional print heads.

Figure 7:
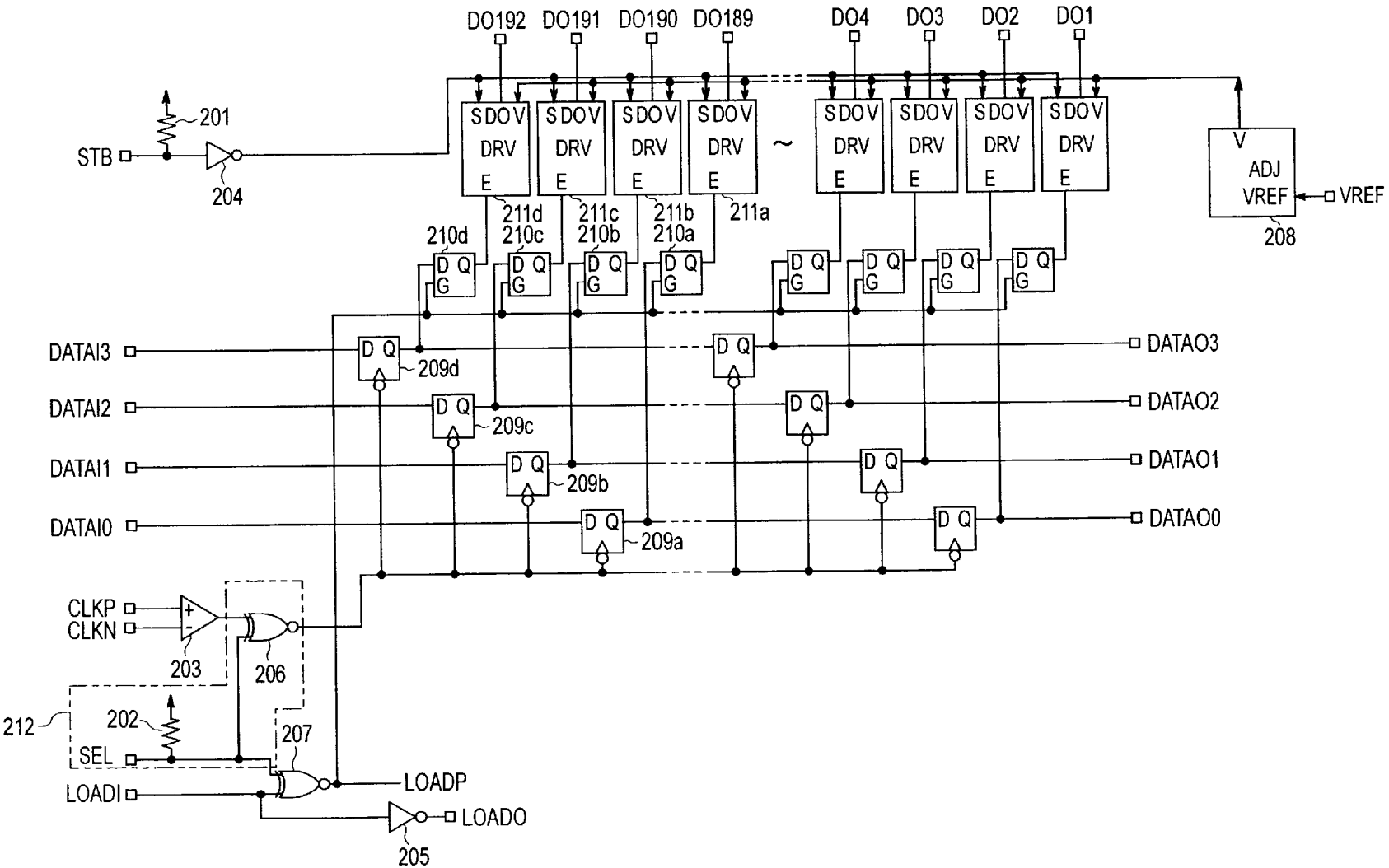
FIG. 7 is a block diagram of a driver IC in a first embodiment of the invention.

In a first embodiment of the invention, each driver IC has the internal structure shown in FIG. 7. Besides input and output terminals for the data and load signals and input terminals for the clock signals, the driver IC has a strobe input terminal (STB), a select input terminal (SEL), and a reference voltage input terminal (VREF). The strobe and select input terminals are connected to the power supply through respective pull-up resistors 201, 202, so that their default logic level is high.

The clock input terminals CLKP, CLKN are coupled to the input terminals of a differential clock input circuit 203. The output of the differential clock input circuit 203 goes high when the CLKP potential is higher than the CLKN potential, and low when the CLKN potential is higher than the CLKP potential. The strobe input terminal STB and load signal input terminal LOADI are coupled to the input terminals of respective inverters 204, 205. The output terminal of inverter 205 is coupled to a load signal output terminal LOADO.

The select input terminal SEL and the output terminal of the differential clock input circuit 203 are coupled to the input terminals of an exclusive-NOR gate 206, the output of which is used as an internal clock signal. The select input terminal SEL and the load input terminal LOADI are coupled to the input terminal of another exclusive-NOR gate 207, the output of which is used as an internal load signal LOADP. The voltage reference input terminal VREF is coupled to a control-voltage generating circuit (ADJ) 208 that generates an internal control voltage (V).

The data input terminals DATAI0 to DATAI3 are coupled to the data input terminals (D) of respective D-type flip-flop circuits 209*a*, 209*b*, 209*c*, 209*d*, referred to below simply as flip-flops. These four flip-flops form the first stages of respective forty-eight-bit shift registers, each comprising forty-eight flip-flops, of which only the first and last flip-flops in each shift register are visible in the drawing. In each shift register, the data input terminal (D) of each flip-flop except the first is coupled to the data output terminal (Q) of the preceding flip-flop. The data output terminals (Q) of the last flip-flops are coupled to data output terminals DATA0 to DATA3. The flip-flops also have clock input terminals that receive the internal clock signal from exclusive-NOR gate 206.

The drive IC also has a latch circuit comprising one hundred ninety-two latch flip-flops coupled to the flip-flops in the shift registers. The first four of these latch flip-flops 210*a*, 210*b*, 210*c*, 210*d*, for example, are coupled to the first-stage flip-flops 209*a*, 209*b*, 209*c*, 209*d* of the shift registers. Each latch flip-flop has a data input terminal (D) coupled to the data output terminal (Q) of the corresponding shift-register flip-flop, a gate input terminal (G) that receives the internal load signal (LOADP), and a data output terminal (Q) that is coupled to the enable (E) input terminal of a corresponding current-driving circuit (DRV). The data output terminals of latch flip-flops 210*a,* 210*b,* 210*c,* 210*d,* for example, are coupled to the enable input terminals of current-driving circuits 211*a,* 211*b,* 211*c,* 211*d.*

The current-driving circuits (DRV) also have strobe input terminals (S) coupled to the output terminal of the inverter 204 that inverts the strobe signal, control voltage input terminals (V) that receive the control voltage from the control-voltage generating circuit 208, and drive output terminals (DO) coupled to respective drive output terminals DO1 to DO192 of the driver IC. When its enable (E) and strobe (S) inputs are both high, a current-driving circuit (DRV) supplies a current determined by the control voltage (V) to its drive output terminal (DO). When either the enable input (E) or the strobe input (S) is low, no current is supplied to the drive output terminal (DO). The drive output terminals DO1 to DO192 of the driver IC are wire-bonded to an LED array chip as described above, each drive output terminal supplying drive current to one LED.

The select input terminal SEL is used to select positive or negative logic for the clock and load signals. In particular, the SEL input terminal, its pull-up resistor 202, and exclusive-NOR gate 206 form a clock inverting circuit 212 that selectively inverts the internal clock signal by reversing the roles of the inputs from the CLKP and CLKN clock input terminals, depending on the state of the SEL input terminal.

Figure 8:
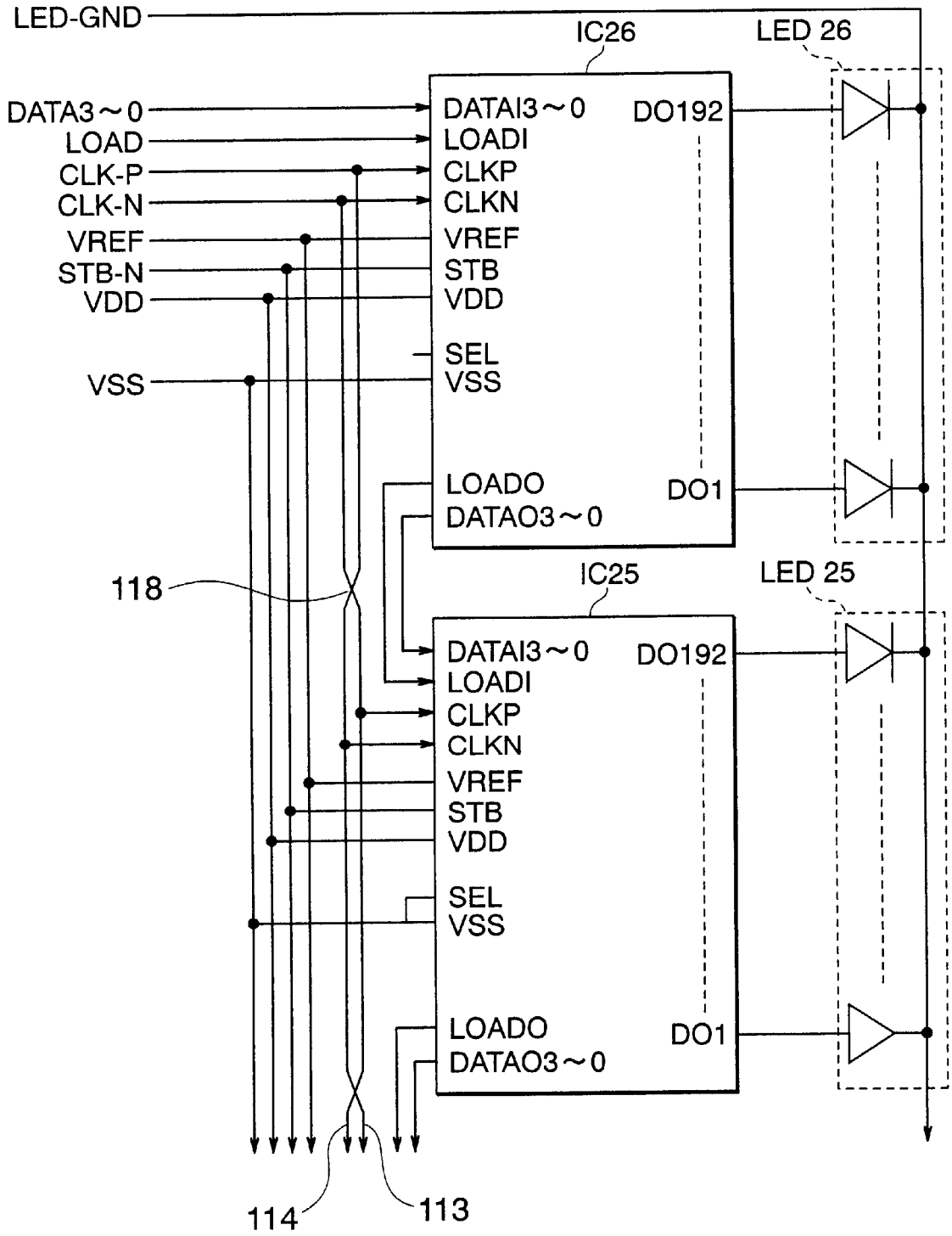
FIG. 8 is a plan view of two driver ICs in the first embodiment, showing their input and output signals.

Referring to FIG. 8, the SEL input terminal is left open in IC26 and other even-numbered driver ICs, and is grounded (connected to the ground potential VSS) in IC25 and other odd-numbered driver ICs. All of the driver ICs receive the same clock signals, but in the even-numbered driver ICs, the CLK-P signal line 113 is coupled to the CLKP input terminal and the CLK-N signal line 114 is coupled to the CLKN input terminal, while in the odd-numbered driver ICs, the CLK-P signal line 113 is coupled to the CLKN input terminal and the CLK-N signal line 114 is coupled to the CLKP input terminal.

This even-odd reversal of the interconnections between the driver ICs and the clock signal lines 113, 114 is due to a positional reversal of the clock signal lines. In FIG. 8, the positional reversal is represented by a crossover of the clock signal lines 113, 114 at points 118 between the driver ICs, but this representation is schematic. As illustrated later, the clock signal lines 113, 114 do not actually cross; their positional reversal is due to a weaving layout which is not shown in FIG. 8. In any case, the reversal of the SEL polarity compensates for the reversal of the clock signal interconnections so that in both even- and odd-numbered driver ICs, the internal clock signal matches the polarity of the CLK-P signal on clock signal line 113.

The load signal from the printing control unit 1 is supplied to the LOADI input terminal of IC26, inverted inside IC26, passed from the LOADO output terminal of IC26 to the LOADI input terminal of IC25, inverted in IC25, and then passed on in similar fashion from each driver IC to the next. The reversal of the SEL input between even- and odd-numbered driver ICs also compensates for the inversion of the load signal inside every driver IC, so that the internal load signal LOADP generated by exclusive-NOR gate 207 always has positive logic. Inverting the load signal as it passes through each driver IC prevents a difference between rise and fall times of the outputs of the inverters 205 that invert the load signal from causing a cumulative increase or decrease in the pulse width of the load signal.

The data signals DATA0 to DATA3 are also passed from one driver IC to the next, but they are not inverted inside the driver ICs.

The strobe signal (STB-N) and reference voltage (VREF) are supplied to the STB and VREF input terminals of all the driver ICs in parallel. All driver ICs are also coupled in parallel to the power supply (VPP) and ground (VSS), and all of the LED array chips (LED26, LED25, . . . ) are coupled to an LED ground signal line (LED-GND). An LED emits light when it conducts current from the corresponding drive output terminal of a driver IC to the LED ground signal line.

Figure 9:
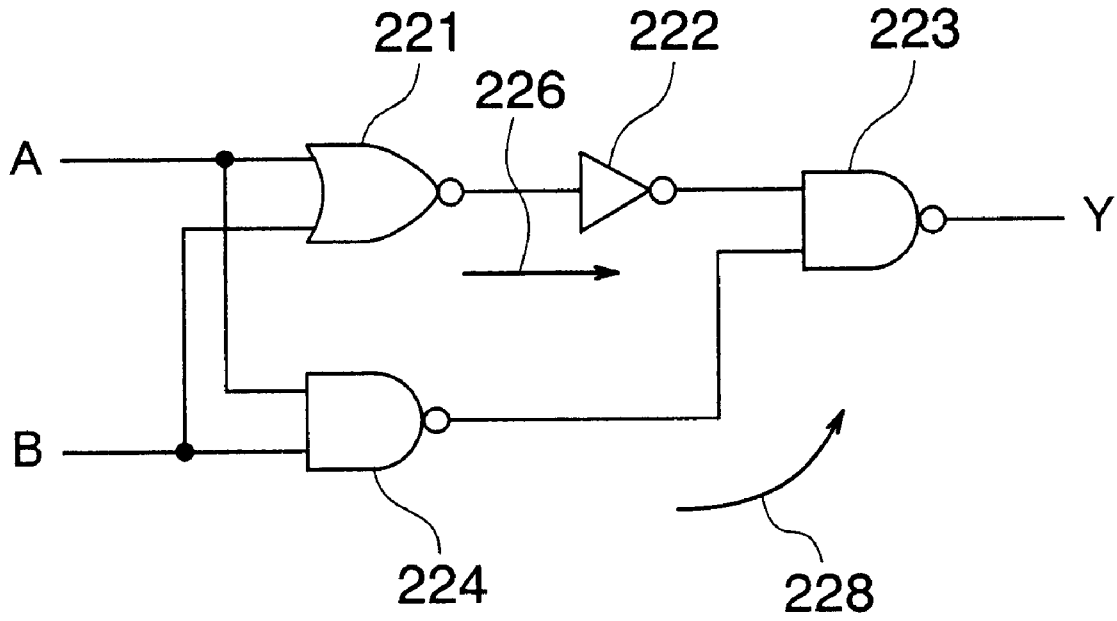
FIG. 9 is a circuit diagram of an exclusive-NOR gate used in the driver IC in FIG. 7.

FIG. 9 shows the internal circuit configuration of an exclusive-NOR gate used as the exclusive-Nor gates 206, 207 in FIG. 7. There are two input signals A and B, of which A is the LOADI input or the output of the differential clock input circuit 203, and B is the select (SEL) input. Input signals A and B are supplied to the two input terminals of a NOR gate 221. The output of NOR gate 221 is inverted by an inverter 222. The output of inverter 222 becomes one input of a NAND gate 223. Input signals A and B are supplied to the two input terminals of another NAND gate 224, the output of which becomes the other input of NAND gate 223. The output Y of NAND gate 223 is high when input signals A and B have the same logic level (both high or both low), and is low when input signals A and B have different logic levels.

In each driver IC, since input B is the select input, it is tied either high or low, while input A varies. When input B is low, input A follows a first path 226 on which it is inverted three times before being output as Y, so A and Y have opposite polarity. When input B is high, input A follows a second path 228 on which it is inverted twice before being output as Y, so A and Y have the same polarity. The propagation delay from A input to Y output is shorter when B is high than when B is low.

Figure 10:
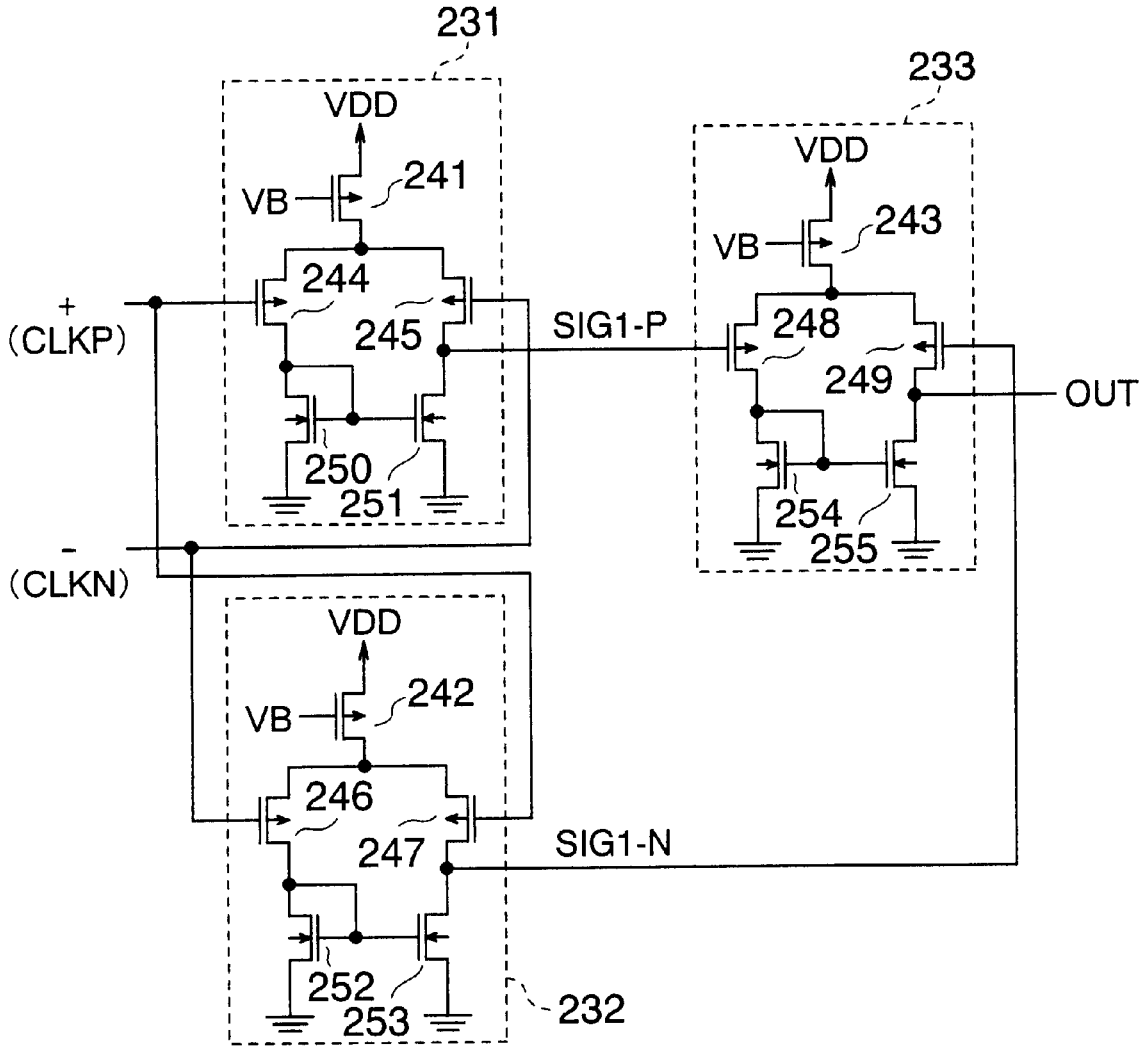
FIG. 10 is a circuit diagram of a differential clock input circuit used in the driver IC in FIG. 7.

FIG. 10 shows the internal circuit configuration of the differential clock input circuit 203. The differential clock input circuit 203 comprises three differential amplifiers 231, 232, 233, which collectively include p-channel metal-oxide-semiconductor (MOS) transistors 241 to 249 and n-channel metal-oxide-semiconductor (MOS) transistors 250 to 255. Each differential amplifier is coupled to the power supply (VDD) and ground, and receives a bias voltage (VB) from a bias-voltage generating circuit (not visible). The circuit as a whole has a non-inverting (+) input terminal coupled to the CLKP input terminal of the driver IC, an inverting (−) input terminal coupled to the CLKN input terminal, and an output terminal (OUT) coupled to the A input terminal of exclusive-NOR gate 206 (not visible).

In differential amplifier 231, p-channel MOS transistor 241 operates as a constant-current source, its source electrode being coupled to the power supply, its gate electrode receiving the bias voltage, and its drain electrode being coupled to the source electrodes of p-channel MOS transistors 244 and 245. N-channel transistors 250, 251 are coupled as respective loads between the drain electrodes of p-channel MOS transistors 244, 245 and ground. The non-inverting (+) input terminal is coupled to the gate electrode of p-channel MOS transistor 244; the inverting (−) input terminal is coupled to the gate electrode of p-channel MOS transistor 245. The output SIG1-P of this differential amplifier 231, which is taken from the node at which the drain electrodes of p-channel MOS transistor 245 and n-channel MOS transistor 251 are interconnected, is proportional to the potential difference (CLKP−CLKN) between the two clock inputs.

Differential amplifier 232 has a similar configuration with the connections of the inverting (−) and non-inverting (+) input terminals reversed. The output SIG1-N of this differential is proportional to the opposite potential difference (CLKN−CLKP).

Differential amplifier 233 also has a similar configuration, receiving SIG1-P and SIG1-N as inputs. The output signal (OUT) is similar to SIG1-P, being proportional to CLKP−CLKN, but with higher gain.

Figure 11:
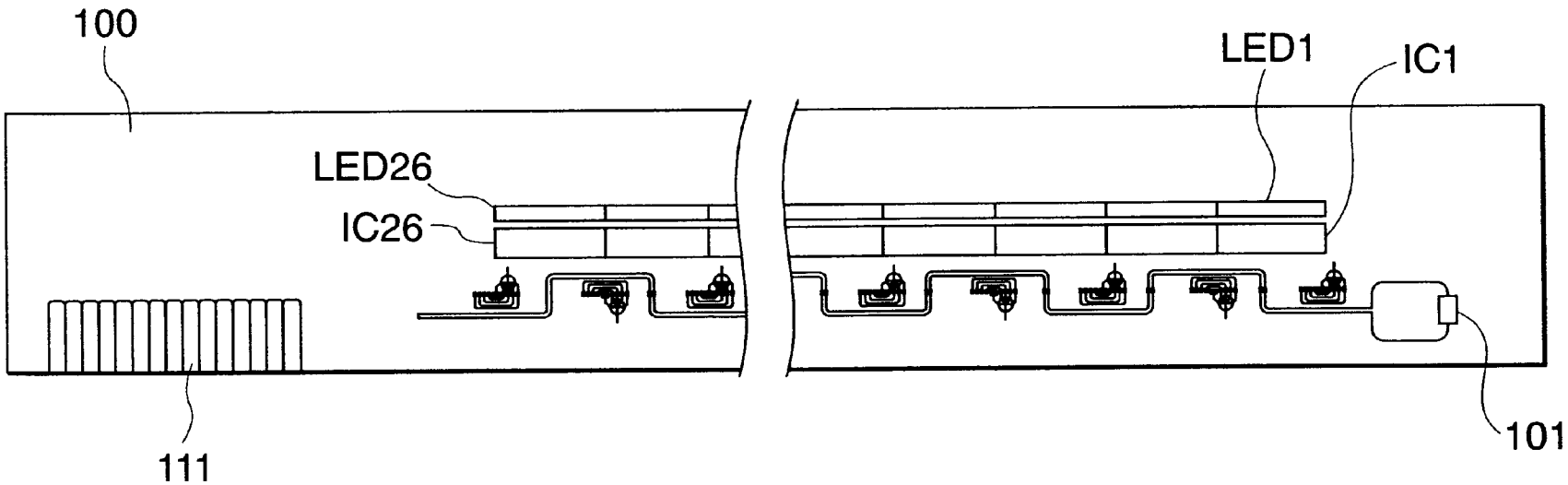
FIG. 11 is a plan view of a printed wiring board used in the first embodiment.

Referring to FIG. 11, the printed wiring board 100 in the LED print head in the first embodiment is generally similar to the conventional printed wiring board shown in FIG. 3, having a card-edge connector 111, a cascaded series of twenty-six driver ICs (IC1 to IC26), twenty-six LED array chips (LED1 to LED26), and a termination resistor 101 for the clock signal lines, but the layout of the clock signal lines differs from the conventional layout.

Figure 12:
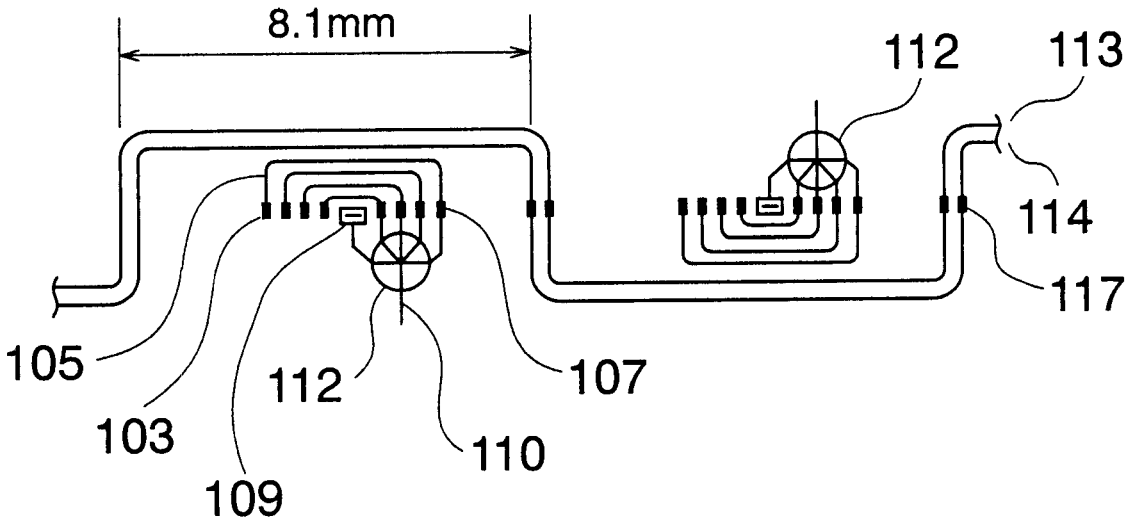
FIG. 12 is an enlarged plan view of some of the signal lines and electrode pads on the printed wiring board in FIG. 11.

Referring to FIG. 12, the electrode pads 103, 107, 109 and wiring patterns 105 that transfer the data and load signals from one driver IC to the next driver IC in the first embodiment are similar to the conventional ones described earlier. The data output terminals DATA0 to DATA03 of the one driver IC are wire-bonded to electrodes 103, which are interconnected by wiring patterns 105 to electrodes 107, and these electrodes 107 are wire-bonded to the data input terminals DATAIO to DATAI3 of the next driver IC. The load output terminal LOADO of the one driver IC and the load input terminal LOADI of the next driver IC are both wire-bonded to electrode pad 109.

To facilitate gold electroplating of the electrode pads 103, 107, 109, electrode pads 107 and 109 are coupled by separate wiring patterns 110 to a power-supply pattern (not visible) in the printed wiring board. These separate wiring patterns 110 are opened by drilling holes 112 after the gold electroplating process and other steps in the fabrication process of the printed wiring board have been completed. (The other steps include application of photoresist, photolithography, and etching of copper foil patterns.) A hole 112 is drilled at the point from which wiring traces radiate to five electrode pads 107, 109 coupled to one driver IC.

The clock signals lines 113, 114 in the first embodiment are disposed side by side, and weave together around the electrode pads 103, 107, 109, wiring patterns 105, 110, and drill holes 112. Since the dot pitch is 1/600 of an inch and there are one hundred ninety-two dots per driver IC, the length of each driver IC is substantially 8.1 millimeters (8.1 mm). The weaving pattern of the clock signal lines 113, 114 is periodic with a repeating period of 16.2 mm, equivalent to the length of two driver ICs.

For wire-bonding to the driver ICs, the clock signal lines 113, 114 have in-line electrode pads 117 instead of stubs. These electrode pads are referred to as in-line because they are aligned directly on the clock signal lines. They are also aligned with the data and load electrode pads 103, 107, 109.

The static capacitances of the two clock input terminals (CLKP, CLKN) of a driver IC may differ slightly, because of variability in IC design and fabrication, but since each clock signal line 113, 114 is coupled to many driver ICs, the differences tend to average out and can in practice be ignored. The two clock signal lines 113, 114 are accordingly analogous to a twisted pair of signal lines, the weaving layout simulating the twisting effect, which is desirable for symmetrical propagation of the differential clock signals. The weaving layout is also desirable because it is the simplest layout that enables the in-line clock electrode pads 117 to be aligned with the other electrode pads 103, 107, 109, which simplifies wire bonding.

The need for a clock inverting circuit 212 in the driver ICs can be appreciated from FIGS. 8 and 12. As FIG. 8 shows, all of the driver ICs have the same arrangement of input terminals. Since it would be undesirable for adjacent bonding wires to cross physically, the desirable weaving layout of the clock signal lines in FIG. 12 forces even-numbered driver ICs to be connected to the clock signal lines in an opposite manner from odd-numbered driver ICs. The clock inverting circuit 212 is needed to compensate for this difference.

Figure 13:
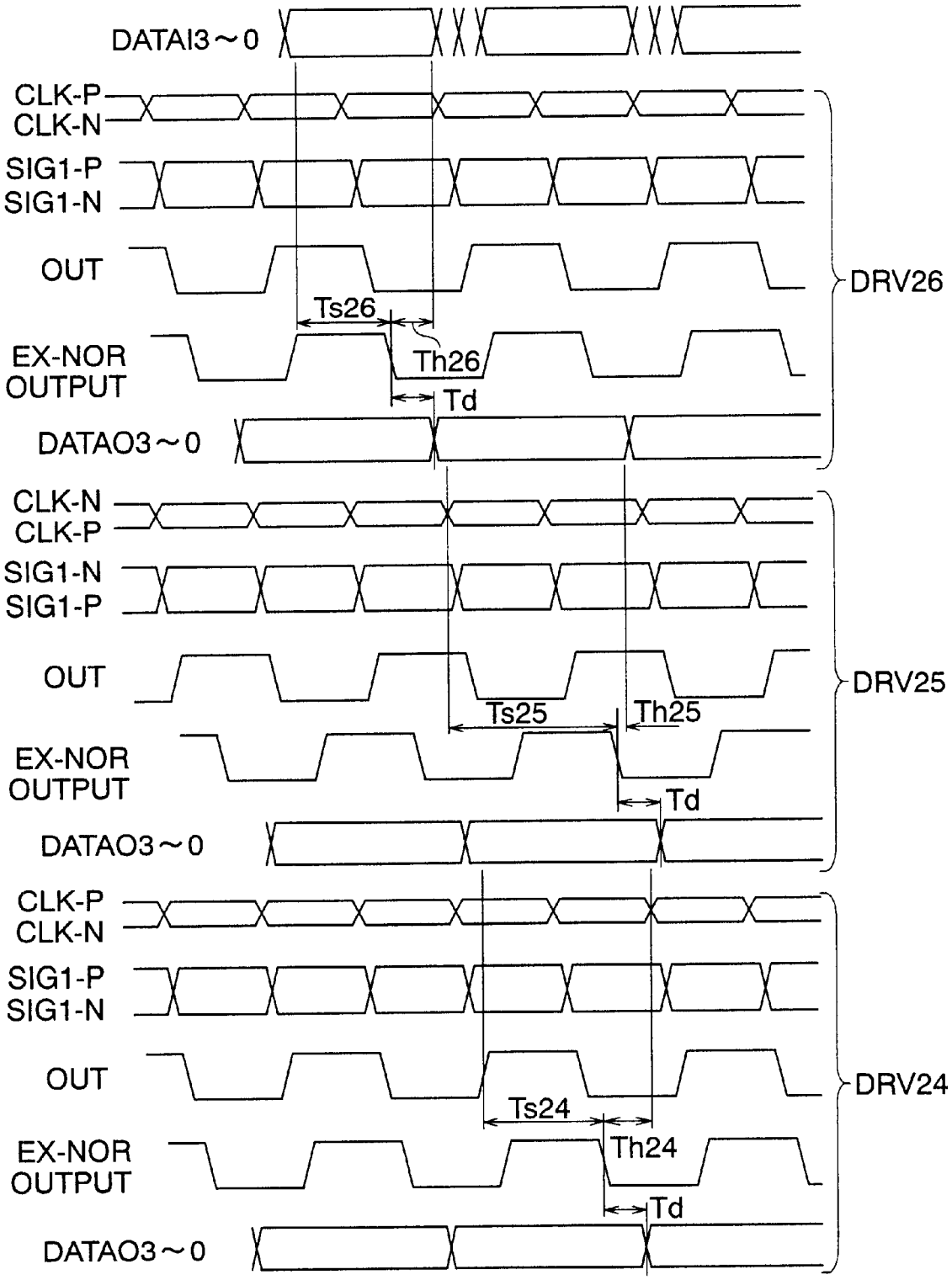
FIG. 13 is a timing diagram illustrating the operation of the first embodiment.

The operation of the first embodiment is illustrated in FIG. 13. Specifically, the operation of IC24, IC25, and IC26, the three driver ICs closest to the card-edge connector 111, is illustrated.

During the transfer of print data from the printing control unit 1 to the LED head 19, four bits of data (for four dots) are transferred per clock cycle on the four data signal lines DATA0 to DATA3. The first waveform in FIG. 13 represents the data signals supplied to the data input terminals (DATAI3~0) of IC26.

For each of the three driver ICs, the following additional waveforms are illustrated: the clock waveforms received at the CLKP and CLKN input terminals; the internal signals SIG1-P and SIG1-N in the differential clock input circuit 203 and its output signal (OUT); the internal clock signal (EX-NOR) output from exclusive-NOR gate 206; and the data signals output at the data output terminals (DATAO3~0).

The CLKP and CLKN waveforms of IC26 and IC24 are nearly identical, but the CLKP and CLKN waveforms of IC25 are opposite in phase; that is, their relative potential levels are reversed. This is because the CLKP input terminal of IC25 is coupled to the same clock signal line as the CLKN input terminals of IC24 and IC26.

In each driver IC, the signals SIG1-P and SIG1-N output by the first-stage differential amplifiers 231, 232 in the differential clock input circuit 203 have waveforms similar to those of CLKP and CLKN, but with larger amplitude swings. The single-ended output signal (OUT) of the second-stage differential amplifier 233 is similar to the CLKP waveform with a still larger amplitude swing. The OUT waveform in IC24 is similar to that in IC26, but the OUT waveform in IC25 is inverted.

The internal clock signals (EX-NOR) have the same polarity in all three driver ICs, because the SEL input terminal of IC25 is grounded, while the SEL input terminals of IC24 and IC26 are pulled up to the high logic level. That is, the exclusive-NOR gate 206 inverts the internal clock signal in IC25, but not in IC24 and IC26. The propagation delay from the differential amplifier output (OUT) to the internal clock signal (EX-NOR) is greater in IC25 than in IC24 and IC26, because the first path 226 in FIG. 9 is followed instead of the second path 228.

The shift registers operate on the falling transitions of the internal clock (EX-NOR) signals. In IC26, the EX-NOR waveform is related to the input data waveform (DATAI3~0) with a setup time Ts26 and a hold time Th26, and to the output data waveform (DATAO3~0) with a data output delay Td, which is the output delay of the last flip-flop in each shift register. In IC25, the EX-NOR waveform is related to the data output (DATAO3~0) waveform of IC26 with a setup time Ts25 and hold time Th25, and to the data output waveform of IC25 itself with the same data output delay Td. In IC24, the EX-NOR waveform is similarly related to the data output waveform of IC25 with a setup time Ts24 and hold time Th24, and to the data output waveform of IC24 with the data output delay Td.

The setup and hold times in other driver ICs are similar to those in IC24 and IC25. The shift-register output delay Td is adjusted to ensure that setup and hold timing requirements are satisfied in all of the driver ICs. The critical parameters are the setup time (e.g., Ts24) in even-numbered driver ICs and the hold time (e.g., Th25) in odd-numbered driver ICs, because in the odd-numbered driver ICs, the setup time is longer and the hold time is shorter than in the even-numbered driver ICs. The difference is due to the different propagation delays in the exclusive-NOR gate 206. The Td adjustment is accomplished by, for example, inserting extra pairs of inverters in the data output lines of the last flip-flops in each shift register.

One effect of the first embodiment is that because the two clock signal lines 113, 114 are mutually adjacent, they are more immune to external electromagnetic noise than in the conventional art, in which the clock signal lines were mutually separated. Even if electromagnetic noise is present, both clock signal lines 113, 114 will experience substantially equal magnetic noise flux, so substantially the same noise voltage will be induced in both clock signal lines, and the potential difference between the two clock signals will remain substantially unchanged. Accordingly, the signals (SIG1-P, SIG1-N, OUT) generated in the differential clock input circuit 203 of each driver IC will be substantially unaffected by the noise.

In tests conducted by the inventor to simulate electrostatic discharge from a human body or other conductor, using standard noise testing procedures with a test capacitance of two hundred picofarads (200 pF), the conventional printed wiring board failed when the test capacitance was charged to a test voltage of five kilovolts (5 kV); that is, a 5-kV discharge caused drive data to be transferred incorrectly to the driver ICs, and printing errors occurred. In contrast, the first embodiment produced no such errors even when the test voltage was raised to twenty-five kilovolts (25 kV), showing a marked improvement in noise immunity.

Another advantage of the first embodiment is the absence of stubs on the clock signal lines 113, 114. In the conventional art, the stubs were a source of signal reflections because they caused discontinuities in the characteristic impedance of the clock signal lines. In the first embodiment, these discontinuities are eliminated, so fewer reflections occur and better pulse waveshapes are maintained as the clock signals propagate along the clock signal lines. This is another factor improving the noise immunity of the first embodiment and increasing the reliability of data transfer.

As noted above, yet another advantage of the first embodiment is that the clock inverting circuit 212 in each driver IC makes possible a weaving layout of the clock signal lines, which provides further noise immunity by simulating the effect of a twisted pair cable, and enables the clock signal electrode pads to be aligned with the data and load signal electrode pads.

Figure 14:
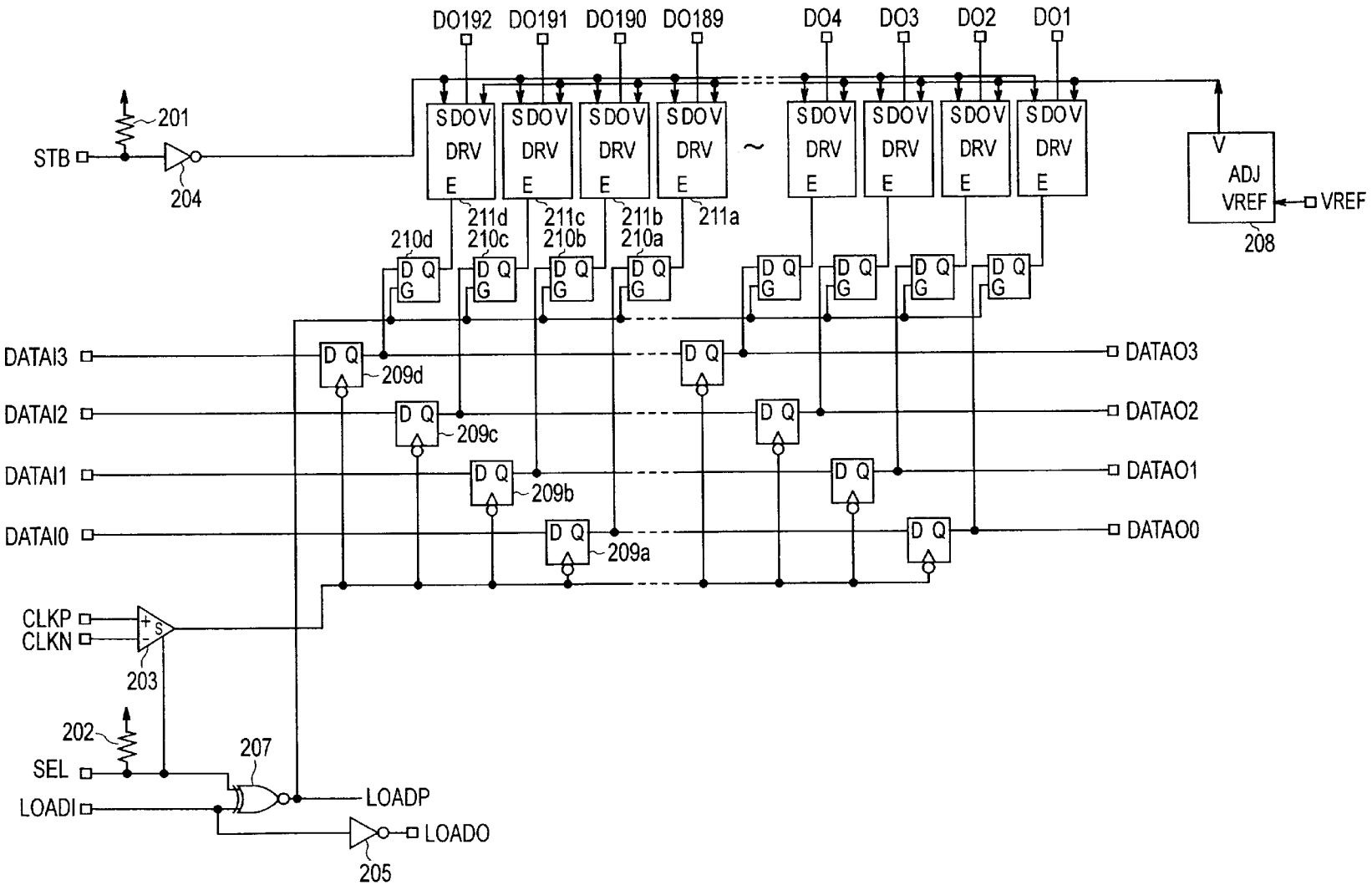
FIG. 14 is a block diagram of a driver IC in a second embodiment of the invention.

Referring to FIG. 14, a second embodiment of the invention differs from the first embodiment in regard to the internal structure of the differential clock input circuit 203. In this second embodiment, the differential clock input circuit 203 is coupled to the select (SEL) input terminal, as well as to the clock input terminals (CLKP and CLKN), and the output signal generated by the differential clock input circuit 203 is supplied directly to flip-flops 209*a*, 209*b*, etc. as the internal clock signal. Accordingly, the second exclusive-NOR gate 206 that was used in the first embodiment is eliminated in the second embodiment.

The other elements of the second embodiment are identical to the corresponding elements of the first embodiment and operate in the same way.

Figure 15:
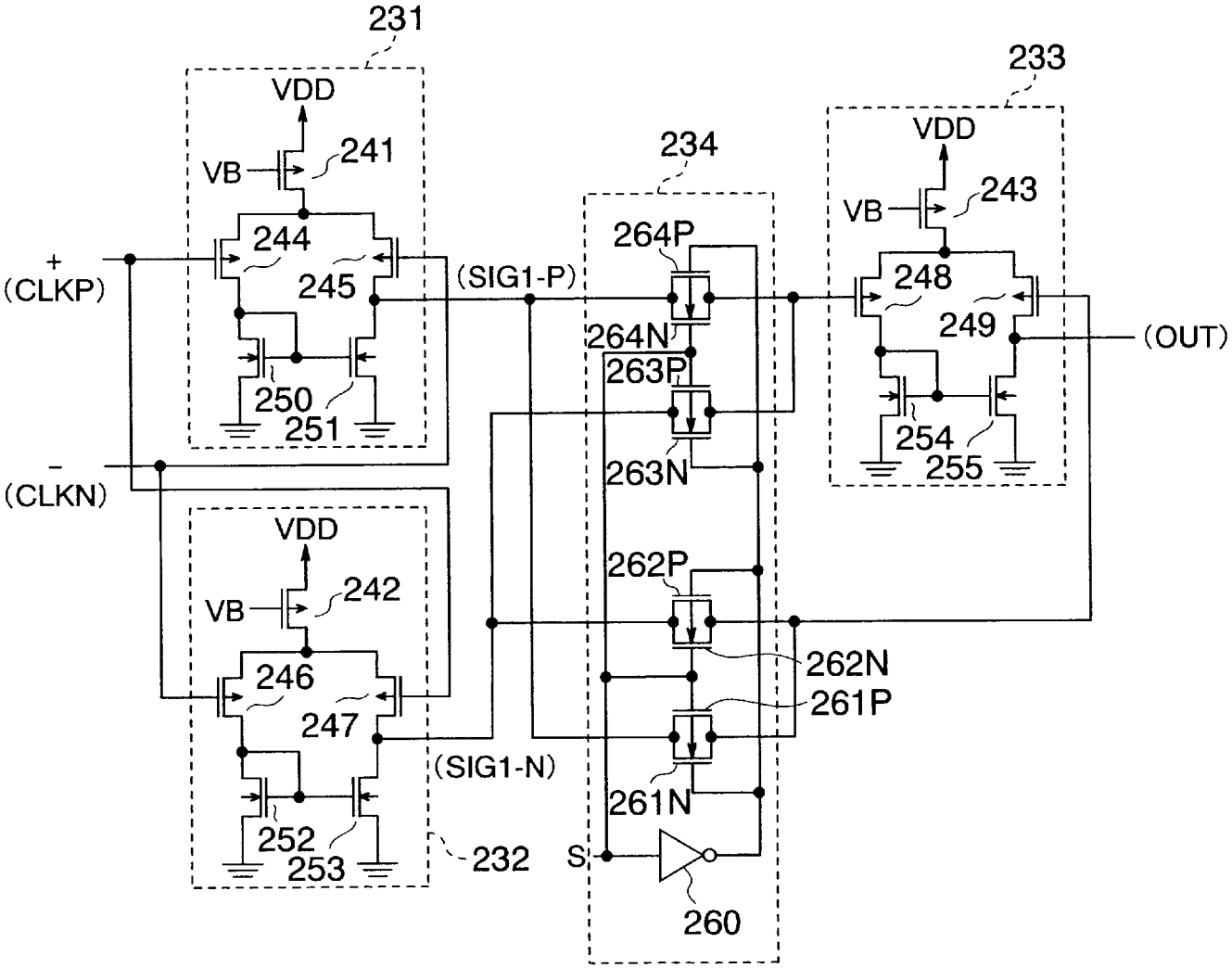
FIG. 15 is a circuit diagram of the differential clock input circuit used in the driver IC in FIG. 14.

Referring to FIG. 15, the differential clock input circuit 203 in the second embodiment includes the same differential amplifiers 231, 232, 233 as in the first embodiment, and an additional switching circuit 234, which functions as a clock inverting circuit. This switching circuit 234, which is inserted between the first-stage differential amplifiers 231, 232 and the second-stage differential amplifier 233, includes an inverter 260 and four analog switches.

The inverter 260 receives and inverts the select signal (S) from the SEL input terminal (not visible). The select signal and the inverted select signal are both supplied to the analog switches, so that each analog switch is controlled by a differential pair of select signals.

The first analog switch includes a p-channel MOS transistor 261P and an n-channel MOS transistor 261N coupled in parallel, the gate electrode of p-channel MOS transistor 261P receiving the select signal (S) from the SEL input terminal, the gate electrode of n-channel MOS transistor 261N receiving the inverted select signal from the inverter 260. When the select signal S is at the low logic level, these transistors 261P, 261N conduct the SIG1-P signal from differential amplifier 231 to the gate electrode of p-channel MOS transistor 249 in differential amplifier 233. When S is at the high logic level, both transistors 261P, 261N are switched off and SIG1-P is not supplied to transistor 249 in differential amplifier 233.

The second analog switch includes a similar pair of MOS transistors, the gate electrode of the n-channel MOS transistor 262N receiving the select signal (S), the gate electrode of the p-channel MOS transistor 262P receiving the inverted select signal. These transistors switch on, conducting the SIG1-N signal from differential amplifier 232 to the gate electrode of transistor 249 in differential amplifier 233, when the select signal S is high, and switch off when S is low.

The third and fourth analog switches are similarly configured. The third analog switch, comprising p-channel MOS transistor 263P and n-channel MOS transistor 263N, conducts the SIG1-N signal from differential amplifier 232 to the gate electrode of p-channel MOS transistor 248 in differential amplifier 233 when the select signal S is at the low logic level. The fourth analog switch, comprising p-channel MOS transistor 264P and n-channel MOS transistor 264N, conducts the SIG1-P signal from differential amplifier 233 to the gate electrode of p-channel MOS transistor 248 in differential amplifier 233 when the select signal S is at the high logic level.

Accordingly, when the select signal S is high, this differential clock input circuit 203 operates in the same way as the differential clock input circuit in the first embodiment, generating an output signal (OUT) proportional to the potential difference (CLKP−CLKN) between the CLKP input terminal and the CLKN input terminal. When the select signal is low, the signals SIG1-P and SIG1-N input to the second-stage differential amplifier 233 are interchanged, so the polarity of the output signal (OUT) is reversed; OUT is now proportional to the opposite potential difference (CLKN−CLKP). The propagation delay of the output signal (OUT) with respect to the amplifier input signals SIG1-P and SIG1-N is preserved un-changed when these input signals are interchanged, because the propagation delay in the differential clock input circuit 203 is the same regardless of whether the select signal S is high or low.

Figure 16:
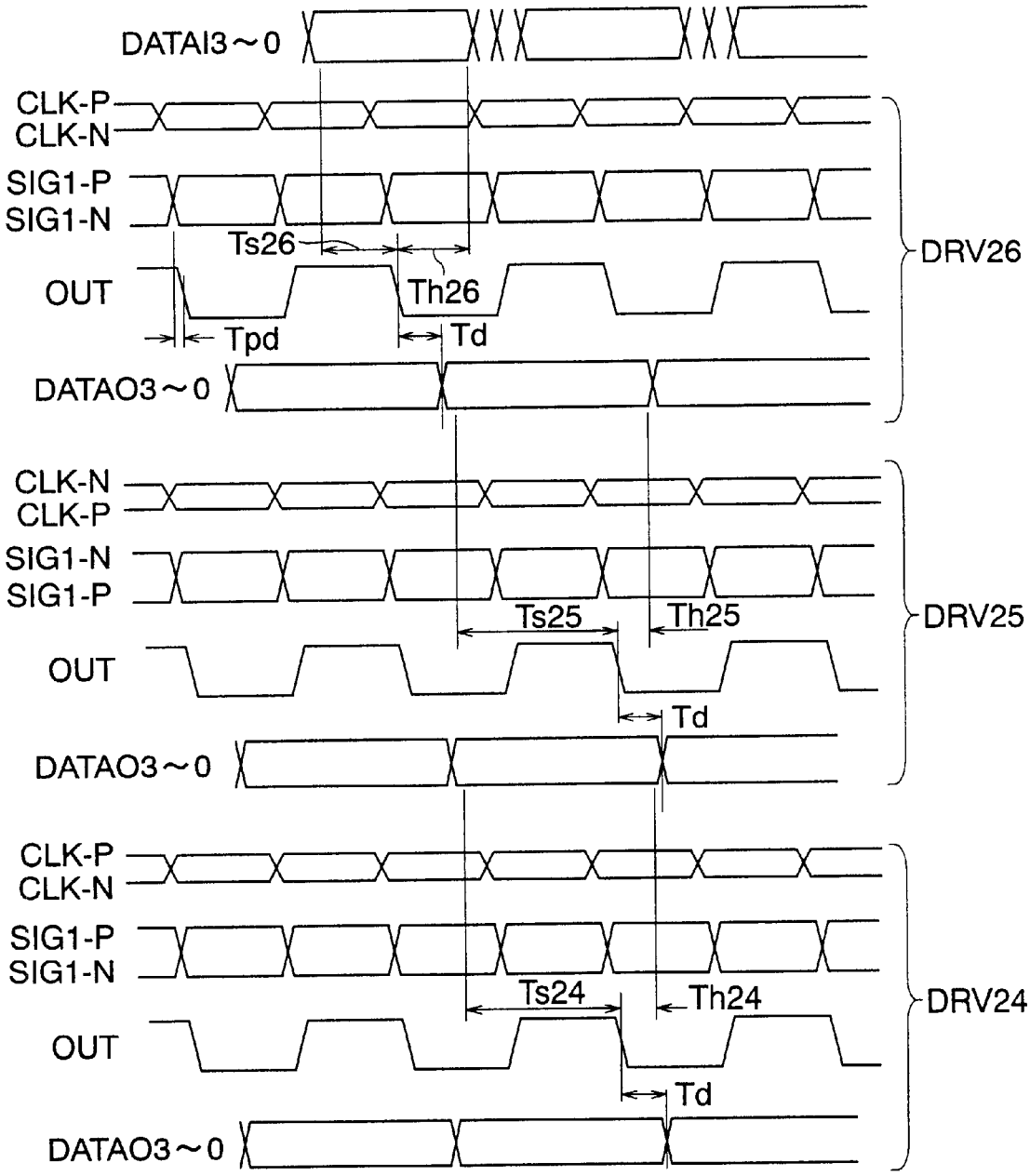
FIG. 16 is a timing diagram illustrating the operation of the second embodiment.

The operation of the second embodiment is illustrated in FIG. 16, which shows the waveform (DATAI3~0) at the data input terminals of IC26, and the following waveforms for each of IC26, IC25, and IC24: the waveforms at the clock input terminals (CLKP and CLKN); the waveforms of the signals (SIG1-P, SIG1-N, OUT) generated in the differential clock input circuit 203; and the waveforms at the data output terminals (DATAO3~0).

The shift registers in the driver ICs operate in synchronization with the internal clock signal (OUT) generated by the differential clock input circuit 203. In even-numbered driver ICs such as IC26 and IC24, the internal clock signal (OUT) has the same polarity as the CLKP input. In odd-numbered driver ICs such as IC25, the internal clock signal (OUT) has the same polarity as the CLKN input, which is the same as the CLKP input polarity in even-numbered driver ICs. Accordingly, the internal clock signal (OUT) has the same polarity in all of the driver ICs.

There is a propagation delay Tpd from the transitions of the SIG1-P and SIG1-N signals to the corresponding transition of the internal clock signal (OUT), and a similar propagation delay from the input transitions at the clock input terminals (CLKP, CLKN) to the corresponding transitions of the SIG1-P and SIG1-N, but these propagation delays are slight. In all of the driver ICs, the shift registers operate nearly in synchronization with the clock signals input at the clock input terminals (CLKP, CLKN).

In IC26, a consequence is that the setup time TS26 and hold time Th26 with respect to the data input signals (DATAI3~0) are both comfortably long.

In IC25, compared with IC26, the setup time Ts25 is lengthened and the hold time Th25 is shortened. The shortening of the hold time Th25 is due to the output delay Td in IC26, but the hold time Th25 is still longer than in the first embodiment, because the propagation delay of the exclusive-NOR gate 206 is eliminated.

The setup time Ts24 and hold time Th24 in IC24 are identical to the setup time Ts25 and hold time Ts25 in IC25. The other driver ICs also have the same setup and hold times as IC24 and IC25. There is no timing difference between even-numbered and odd-numbered driver ICs, because the exclusive-NOR gate 206 of the first embodiment has been eliminated, and the propagation delay in the differential clock input circuit 203 is the same regardless of the level of the select signal.

The second embodiment provides the same effect of improved noise immunity as the first embodiment, and the following additional effect. Since both even-numbered and odd-numbered driver ICs have the same setup and hold times, it is easier to adjust the output delay Td of the shift registers in the driver ICs to ensure that timing requirements are met. As can be seen from a comparison of FIGS. 13 and 16, the critical timing parameters Ts24 and Th25 are larger in the second embodiment than in the first embodiment.

More specifically, the sum of the critical timing parameters (Ts24+Th25) is substantially equal to one clock cycle in the second embodiment, but is less than one clock cycle in the first embodiment. Accordingly, the clock cycle time can be shorter in the second embodiment than in the first embodiment, enabling the second embodiment to operate at a higher clock frequency than the first embodiment. As a result, data can be transferred to the print head faster, and the printing speed can be increased.

In the embodiments described above, all driver ICs had identical internal structures, but the invention can also be practiced by providing two types of driver ICs, one type for use in even-numbered positions and another type for use in odd-numbered positions in the cascaded series, thereby eliminating the need for a select (SEL) input terminal. In this case, only the odd-numbered driver ICs (or only the even-numbered ones) need to have a clock inverting circuit.

The exclusive-NOR gates of the first embodiment can be replaced with exclusive-OR gates. Both types of exclusive logic gates yield similar effects.

The driver ICs may of course be numbered so that the first driver IC in the cascaded series is odd-numbered instead of even-numbered.

The invention has been described in relation to an electrophotographic printer of the LED type, but can also be practiced in thermal printers, to provide improved noise immunity and faster printing speeds.

Those skilled in the art will recognize that further variations are possible within the scope claimed below.

What is claimed is:

1. A driving circuit receiving print data and a pair of differential clock signals, and supplying driving current to an array of recording elements according to the print data, having a cascaded series of driver integrated circuits, and transferring the print data through the cascaded series of driver integrated circuits in synchronization with the differential clock signals, wherein:

each driver integrated circuit in the cascaded series has a first clock input terminal and a second clock input terminal;

a first driver integrated circuit in the cascaded series receives one of the differential clock signals at its first clock input terminal and receives another one of the differential clock signals at its second clock input terminal;

a second driver integrated circuit, following the first driver integrated circuit in the cascaded series, receives said one of the differential clock signals at its second clock input terminal and receives said another one of the differential clock signals at its first clock input terminal;

the first clock input terminal of the first driver integrated circuit is connected to the second clock input terminal of the second driver integrated circuit; and the second clock input terminal of the first driver integrated circuit is connected to the first clock input terminal of the second driver integrated circuit.

2. The driving circuit of claim 1, comprising:

a first clock signal line carrying said one of the differential clock signals; and a second clock signal line carrying said another one of the differential clock signals;

wherein the cascaded series of driver integrated circuits are numbered consecutively from said first driver integrated circuit to a last driver integrated circuit, said driver integrated circuits also have respective data input terminals and data output terminals, the data input terminals and data output terminals are mutually interconnected for transfer of the print data through the cascaded series of driver integrated circuits from the first driver integrated circuit to the last driver integrated circuit, the first clock input terminals of odd-numbered driver integrated circuits and the second clock input terminals of even-numbered driver integrated circuits in the cascaded series are coupled to the first clock signal line, the second clock input terminals of the odd-numbered driver integrated circuits and the first clock input terminals of the even-numbered driver integrated circuits are coupled to the second clock signal line, each driver integrated circuit in the cascaded series generates an internal clock signal from the differential clock signals received at its first clock input terminal and its second clock input terminal and uses the internal clock signal to synchronize the transfer of the print data, and at least the even-numbered driver integrated circuits have a clock inverting circuit for inverting the internal clock signal.

3. The driving circuit of claim 2, wherein said clock inverting circuit is present in every said driver integrated circuit in the cascaded series, and every said driver integrated circuit also has a select input terminal coupled to the clock inverting circuit, for control of the clock inverting circuit, the select input terminals of the odd-numbered driver integrated circuits being held at one logic level and the select input terminals of the even-numbered driver integrated circuits being held at another logic level.

4. The driving circuit of claim 3, wherein the clock inverting circuit comprises an exclusive logic gate.

5. The driving circuit of claim 3, wherein:

each said driver integrated circuit has a differential amplifier generating said internal clock signal from two amplifier input signals, the amplifier input signals deriving from the pair of differential clock signals received at the first clock input terminal and the second clock input terminal; and the clock inverting circuit comprises a switching circuit for selectively interchanging the two amplifier input signals.

6. The driving circuit of claim 5, wherein the switching circuit comprises a plurality of analog switches having respective p-channel metal-oxide-semiconductor transistors and n-channel metal-oxide-semiconductor transistors.

7. The driving circuit of claim 6, wherein the analog switches have mutually equal propagation delays, the switching circuit thus preserving timing relationships when interchanging the amplifier input signals.

8. The driving circuit of claim 1, wherein each said driver integrated circuit has a select input terminal receiving a select signal, and an internal clock generating circuit generating an internal clock signal from the select signal and the pair of differential clock signals.

9. The driving circuit of claim 8, wherein the select signal received at the select input terminal of the first driver integrated circuit and the select signal received at the select input terminal of the second driver integrated circuit have different logic levels.

10. A printed wiring board on which are mounted a plurality of driver integrated circuits that supply driving current to an array of recording elements responsive to print data, the printed wiring board comprising:

a plurality of electrode pads for supplying signals to and receiving signals from the driver integrated circuits;

a plurality of wiring patterns for interconnecting the electrode pads so that the driver integrated circuits form a cascaded series including at least a first driver integrated circuit and a second driver integrated circuit, the second driver integrated circuit being adjacent to the first driver integrated circuit in the cascaded series;

for each driver integrated circuit in the cascaded series, a first clock pad and a second clock pad for supplying a pair of differential clock signals to the driver integrated circuit;

a first clock signal line coupling the first clock pad of the first driver integrated circuit to the second clock pad of the second driver integrated circuit, for carrying one of the pair of differential clock signals to the first driver integrated circuit and the second driver integrated circuit; and a second clock signal line coupling the second clock pad of the first driver integrated circuit to the first clock pad of the second driver integrated circuit, for carrying another one of the pair of differential clock signals to the first driver integrated circuit and the second driver integrated circuit.

11. The printed wiring board of claim 10, wherein:

the driver integrated circuits in the cascaded series are numbered consecutively from the first driver integrated circuit to a last driver integrated circuit;

said wiring patterns transfer the print data through the cascaded series of driver integrated circuits from the first driver integrated circuit to the last driver integrated circuit;

the first clock signal line carries said one of the differential clock signals to the first clock pads of odd-numbered driver integrated circuits and the second clock pads of even-numbered driver integrated circuits in the cascaded series; and the second clock signal line carries said another one of the differential clock signals to the second clock pads of the odd-numbered driver integrated circuits and the first clock pads of the even-numbered driver integrated circuits in the cascaded series.

12. The printed wiring board of claim 11, wherein the first clock signal line and the second clock signal line are mutually adjacent.

13. The printed wiring board of claim 11, wherein the first clock signal line and the second clock signal line weave around said electrode pads.

14. The printed wiring board of claim 11, wherein the first clock signal line and the second clock signal line weave around said wiring patterns.

15. The printed wiring board of claim 11, wherein the first clock pad of each odd-numbered driver integrated circuit and the second clock pad of each even-numbered driver integrated circuit are in-line with the first clock signal line, and the second clock pad of each odd-numbered driver integrated circuit and the first clock pad of each even-numbered driver integrated circuit are in-line with the second clock signal line.

16. A print head including the printed wiring board of claim 10, said driver integrated circuits, and said recording elements.

17. The print head of claim 16, wherein said recording elements are light-emitting diodes.

18. The printed wiring board of claim 10, wherein the first driver integrated circuit and the second driver integrated circuit have respective select signal input pads for input of a select signal, and respective internal clock generating circuits generating respective internal clock signals from the select signal and the pair of differential clock signals.

19. The printed wiring board of claim 18, further comprising a ground pad for supply of a ground potential, wherein the select input pad of one of the first driver integrated circuit and the second driver integrated circuit is connected to the ground pad.

* * * * *